United States Patent [19]

Perneczky

[11] Patent Number: 4,528,716

[45] Date of Patent: Jul. 16, 1985

[54] APPARATUS FOR CLEANING ROLLER ASSEMBLIES

[76] Inventor: George C. Perneczky, 8918 Biloba, Orland Park, Ill. 60462

[21] Appl. No.: 564,251

[22] Filed: Dec. 21, 1983

[51] Int. Cl.[3] ..... D21G 3/02

[52] U.S. Cl. ..... 15/256.51; 162/281

[58] Field of Search ..... 15/256.51; 355/15; 162/281

[56] References Cited

U.S. PATENT DOCUMENTS 3,361,059 1/1968 Klingler ..... 15/256.51 X
3,748,686 7/1973 Winterburn et al. ..... 15/256.51
4,192,709 3/1980 Dunlap ..... 162/281 X
4,367,120 1/1983 Hendrikz ..... 162/281
4,451,140 5/1984 Saito ..... 15/256.51 X

*Primary Examiner*—Chris K. Moore
*Attorney, Agent, or Firm*—Kirkland & Ellis

[57] ABSTRACT

The present invention relates to an apparatus for use in cleaning scraps of metal and other materials from rollers used in the rolling of sheet stock. The apparatus is characterized by a knife-edge blade which is positioned to contact the surface of such rollers. The blade is attached to a support structure adapted for ready positioning of the blade against the roller.

12 Claims, 11 Drawing Figures

APPARATUS FOR CLEANING ROLLER ASSEMBLIES

BACKGROUND OF THE INVENTION

1. Field of the Invention

The present invention generally relates to an apparatus for use in cleaning scraps of metal and other materials from rollers used in the rolling of sheet stock such as, for example, sheet steel, sheet plastic, paper, and the like.

2. Description of the Prior Art

During the manufacture and processing of sheet stock, such as, for example, sheet steel, sheet plastic, paper, and the like, it is oftentimes advantageous to wind the sheet stock on rolls for ease of handling, storage, and transportation. In preparing such large rolls of stock, it is often necessary to translate the sheet stock through a series of motor and friction driven rollers prior to the final stage of forming the large roll. During the translation of the sheet stock across the motor and friction driven rollers, particles of metal, plastic, paper, and the like, may become dislodged from the edge of the stock and may become embedded in or otherwise damage the surface of the motor and friction rollers. For example, in steel industry rolling mills, it has long been recognized that small metallic pieces, or chips, of the sheet steel stock being processed are dislodged from the edge of the strips and build up on the surface of the motor and/or friction driven rollers used in the mills. These chips often penetrate the rubber lagging, or surface covering, of the rollers, with the result of not only damaging the surface of the rollers themselves but also damaging the stock being processed, such as by scratching or marking the stock. Obviously, metal, plastic, or other material so damaged cannot be used in producing a final consumer product because of surface imperfections caused by such scratching. Indeed, in certain steel industry rolling mill operations, surface scratching caused by the small metallic chips account for approximately 5–10% wastage of the processed sheet metal.

In addition, rollers which are damaged by the small chips have to be removed in order to reduce the occurrence of damage to the sheet metal. In such instance, the operations of the rolling mill line must be shut down until the damaged rolls can be replaced, thereby contributing expense to the rolling mill process. Further, for rolls having a rubber lagging, it is necessary to replace the lagging containing embedded chips. This results in additional expenses. For example, it is known that in certain steel industry rolling mill operations, downtime of the rolling mill apparatus may represent a cost approaching approximately $500.00 per minute of down-time. And, the cost of replacing the rubber lagging is not inexpensive. In normal steel industry rolling mill operations, that cost may be as high as $400.00 per roll.

In the current rolling mill and other similar operations, various types of brushes have been used to clean the rolls. However, this brushing technique has met with only limited success. Using the rolling mill operations of the steel industry as yet a further example, even in those operations using the brushing technique, the rolls must be frequently replaced; for example, it may be necessary to change the lagging on the rolls as frequently as 3 times per week. Due to the expensive nature of the lagging, and the additional expense associated with stopping the rolling mill operation to remove the rolls, it is apparent that brushing and other comparable techniques currently used are insufficient to clean the rolls.

On the other hand, the novel apparatus of the present invention overcomes the foregoing deficiencies noted in the prior art by providing an apparatus which cleans the rolls, generally in the area surrounding the edges of the strip being processed for longer rolls and for shorter rolls across the entire length of the roll, and removes therefrom the small chips which may damage the rolls and the sheet stock. Accordingly, it is an object of the present invention to provide an apparatus for cleaning rolls which does not have the inherent deficiencies of the prior art.

It is another object of the present invention to provide a cleaning apparatus which includes a knife edge positioned on the surface of the roll, thereby allowing the small chips to be removed from the roll prior to penetrating the surface of the roll or otherwise damaging the surface of the sheet stock.

It is yet a further object of the present invention to provide a cleaning apparatus which is adjustable through numerous axis so as to permit ready placement of the knife edge against the roll being cleaned.

These and other objects and advantages of the present invention will become apparent to those skilled in the art with reference to the foregoing, the attached drawings, and the description of the invention which hereinafter follows.

SUMMARY OF THE INVENTIONS

The present invention provides a cleaning apparatus for use in cleaning rotating rolls. The apparatus comprises a knife edge attached to a flexible arm. The arm is attached to a support structure which includes a hinge mechanism for rotating the support structure, thereby assuring that the knife edge can be positioned against the rotating roll. The support structure also includes a further hinge which allows the entire support structure to be rotated from the surface of the roll in the event the sheet stock becomes dislodged from the surface of the rolls. This additional hinge also allows the support structure to be rotated out of the way for ease of access to the rolls.

DESCRIPTION OF THE PREFERRED EMBODIMENT

The present invention relates to an apparatus for use in rollings mills and, in particular, to an apparatus used for cleaning rolls and removing from the rolls pieces of metal chips or other materials which fall off of the sheet stock being processed in the rolling mill.

Figure 1:
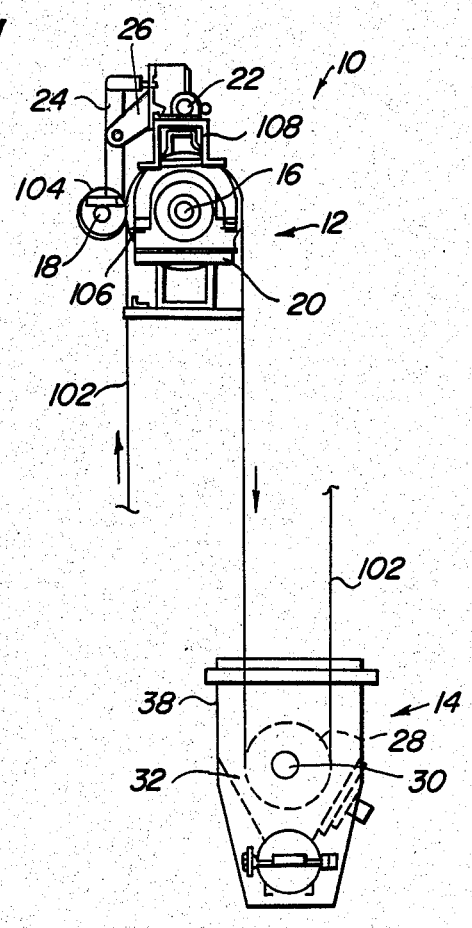
FIG. 1 is a partial cross-section of a portion of a rolling mill unit used in the steel industry for the electroplating of sheet steel stock and is provided solely for the purpose of describing generally the types of rolling mill units upon which the apparatus of the present invention can be used.

FIG. 1 depicts a section of a roll unit typically found in rolling mills. The section shown in FIG. 1 may be found in such industries as the steel industry and is used for electroplating sheet steel. As there shown, a plating apparatus section 10 comprises an upper component 12 and a lower component 14. As will be appreciated, during the electroplating of sheet steel stock, it is generally preferred that more than one of the sections 10 shown in FIG. 1 be utilized. However, for convenience and in respect of the present invention, it is only necessary to describe generally the plating apparatus section 10 as shown in FIG. 1.

The upper component 12 includes a shaft 16 positioned longitudinally through the center of a motor driven roller 106. The shaft 16 is supported at each end by end pieces 20 (only one such end piece is shown) to which is attached a C-channel 108. The C-channel 108 extends the length of the motor driver roller 106 along the longitudinal axis thereof. Positioned above the C-channel 108 is a shaft 22 for purposes hereinafter described. Also shown in FIG. 1 is a shaft 18 which is positioned parallel to the longitudinal axis of the shaft 16. A friction-driven roller 104 surrounds the shaft 18 and is positioned adjacent to the motor driven roller 106. Each end of the shaft 18 is attached to an arm 24 and is braced with a brace 26. The brace 26 is attached to the shaft 22 and cooperates with the arm 24 to insure that the friction roller 104 remains in close proximity to the motor driven roller 106 during operation of the plating apparatus 10.

When the plating apparatus section 10 of FIG. 1 is in use, sheet stock 102 moves between the rollers 104 and 106 in the direction noted by the arrows. This movement is caused by the rotation of the motor driven roller 106. Typically, the movement of the sheet stock is quite rapid, with the stock moving from about 1200 to about 2400 feet per minute, and the rotation of the friction roller 104 being in the range of about 300 to about 900 rpm, dependent on the diameter of the roller 104.

As noted, the plating apparatus 10 also includes the lower component 14. The lower component 14 comprises a bath housing 38 which surrounds a roller 28. The roller 28 is positioned on a shaft 30 which runs through the longitudinal axis thereof. When the apparatus such as plating apparatus 10 is used to plate sheet steel stock, an electroplating solution 32 is found in the bath housing 38. Electroplating action takes place when the sheet steel 102 travels through the solution 32 and is subjected to electrolysis action.

Figure 2:
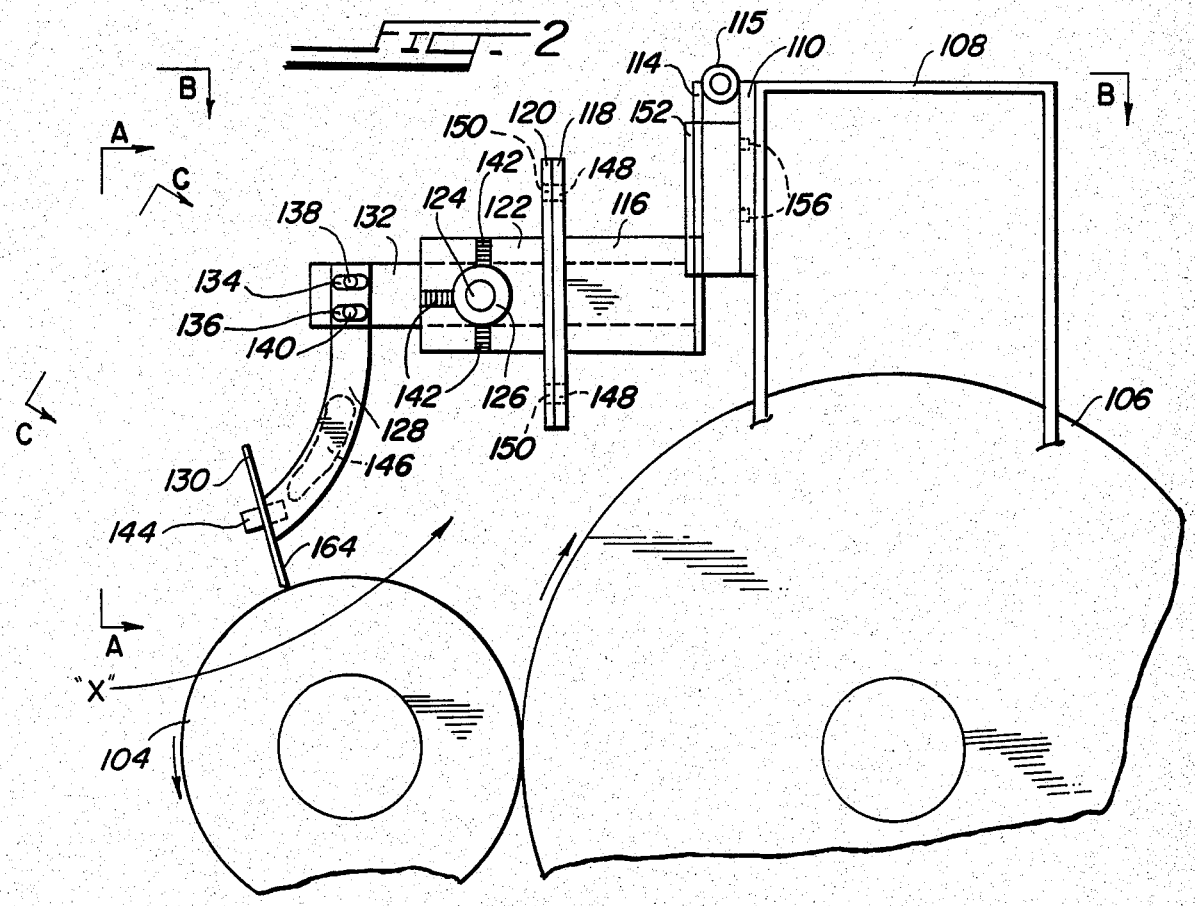
FIG. 2 is a cross-section of the apparatus of the present invention shown in connection with the C-channel depicted in FIG. 1.

The cleaning unit 100 apparatus (see FIG. 3) of the present invention is shown generally in FIG. 2. As noted subsequently, the apparatus may include more than one of the units 100, depending on the length of the roller 104; however, only one such unit is described herein for convenience, it being understood that the other such units are constructed in substantially the same way.

Figure 7A:
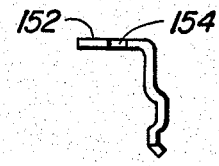
FIG. 7A is an end view of the releaseable clip.
Figure 7B:
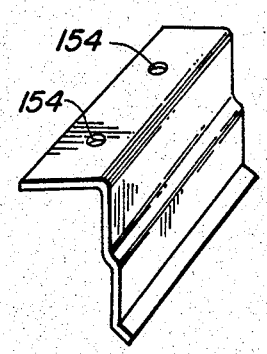
FIG. 7B is a perspective view of the releaseable clip.
Figure 8:
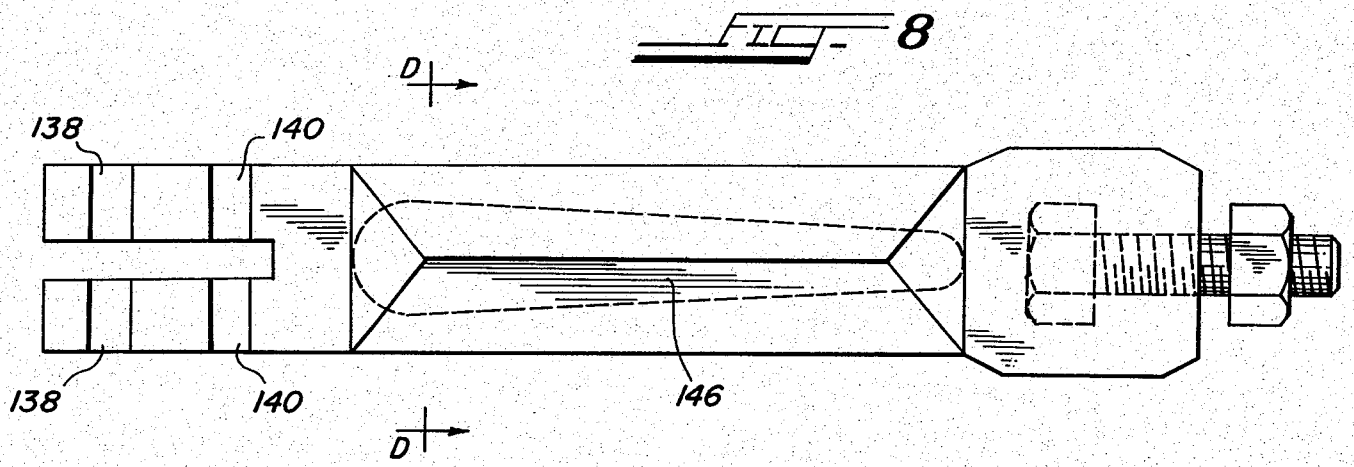
FIG. 8 is a front view of the blade support shown in FIG. 2, taken along the lines C—C, with the blade and blade support attachment removed for clarity.

As shown in FIG. 2, a base plate 110 is attached to the C-channel 108. A hinge 115 is attached both to the base plate 110 and a hinge plate 114. The base plate 110 is provided with attachment holes 156 for the purposes of attaching, as by bolts, screws, etc., a releaseable clip 152 (see also FIGS. 7A and 7B). The attachment holes 154 of the releaseable clip 152 (shown in FIG. 7B) mate with the attachment holes 156 in the blade base plate 110, and bolts, screws, and the like, are placed therethrough to attach the clip 152 to the plate 110. The releaseable clip 152 (FIG. 7A) is made preferrably of a thin metal material, such as for example, 3/32 inch thick stainless steel-type 304, for purposes hereinafter described.

One end of a hinge plate support 116 is attached, as by welding, to the hinge plate 114 and the other end of the hinge plate support 116 is attached, as by welding, to a hinge plate support plate 118. In addition, a pipe support 122 is attached, as by welding, to a pipe support plate 120. The pipe support 122 includes an aperture 124 directed longitudinally therethrough for receipt of a pipe 126 for purposes hereinafter described. A blade support attachment 132 is attached at one end thereof to the pipe 126 at a location hereinafter described and at the other end thereof to a blade support 128. The blade support 128, which is attached to the blade support attachment 132 by bolts, and the like, passing through slots 134 and 136 of attachment 132 and holes 138, 140 of blade support 128, includes a blade 130 which can be positioned such that the tip 164 thereof makes contact with the surface of the friction roller 104.

Figure 3:
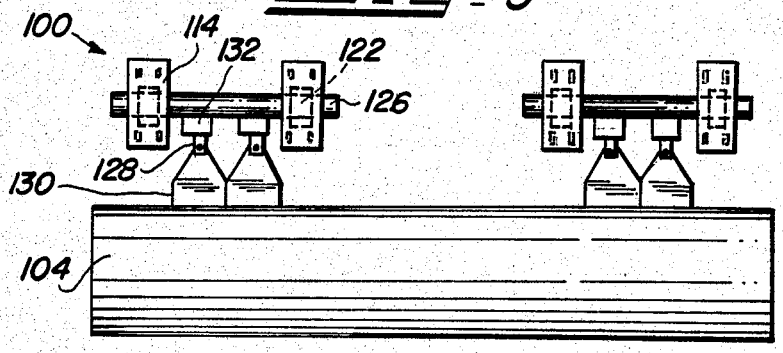
FIG. 3 is a front elevation view of FIG. 2, taken along the lines A—A, with the motor driven roller removed for clarity, showing the apparatus of the present invention.

With reference to FIG. 3, an end view of FIG. 2, taken along the lines A—A, is shown. As there noted, for each friction roller 104, two separate cleaning units 100 are provided. It has been found through experimentation that metal or other material particles and chips which can damage the surface of the friction roller 104 are most often found along the edges of the sheet stock 102. Thus, the present invention advantageously cleans that portion of the friction roller 104 underlying the area adjacent the edges of the sheet stock 102. For the purposes of the present disclosure, only one such cleaning unit 100 will be described, it being understood that when narrow stock is processed, it may only be necessary to utilize one unit 100 to cover the portion of the roller 104 underlying the edges of the stock 102.

Regarding FIG. 3, the blade support attachment 132 is attached to the pipe 126 which is positioned through the apertures 124 of the pipe supports 122. In order to clean a wide area of the roller 104, two blade support attachments 132 are shown for each unit 100; however, it should be understood that only one such attachment 132 is necessary if a narrower area of the roller 104 needs to be cleaned. The exact number of such attachments 132 is only dependent upon the width of the area of roller 104 to be cleaned. The blade support attachment 132 is attached, as by welding, to the pipe 126 at a location between the two pipe supports 122 shown in FIG. 3.

Figure 4:
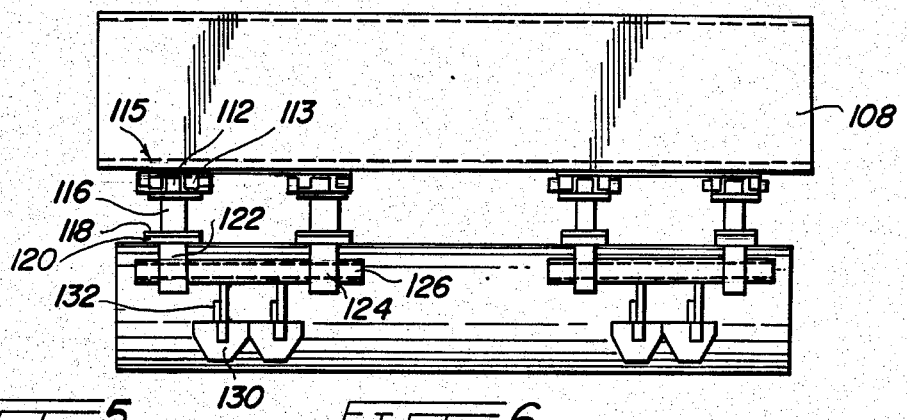
FIG. 4 is a top view of FIG. 2, taken along the lines B—B, with the motor driven roller removed for clarity, showing the apparatus of the present invention.

As shown in FIG. 4, the hinge 115 comprises hinge sections 113, attached, as by welding, to the base plate 110, and a hinge tube 112 attached to the hinge plate 114. The hinge 115 is formed when a pin is positioned through the center aperture (not shown) of the hinge sections 113 and the hinge tube 112. When so positioned, the cleaning unit 100 may rotate about the hinge 115.

Figure 5:
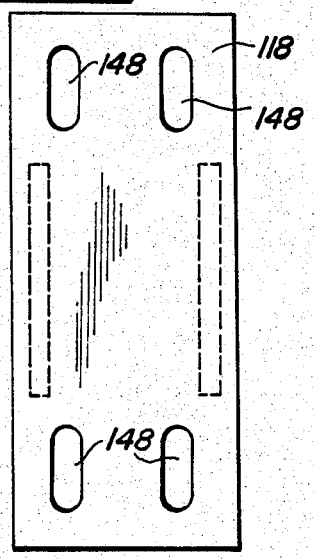
FIG. 5 depicts an end view of the hinge plate support plate.
Figure 6:
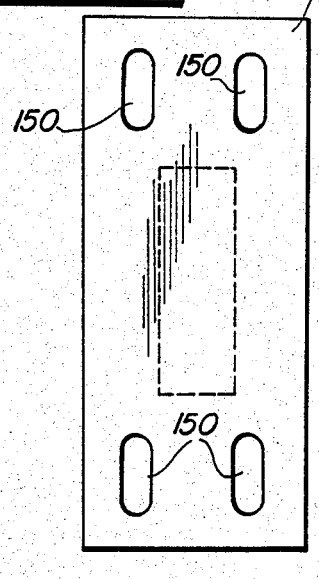
FIG. 6 depicts an end view of the pipe support plate.

The hinge plate support plate 118, as depicted in FIG. 2, is also shown in FIG. 5. As shown in the latter figure, the hinge plate support plate 118 is provided with a plurality of slots 148 to be aligned with the slots 150 of the pipe support plate 120 (see FIG. 6). The hinge plate support plate 118 and the pipe support plate 120 may be joined with bolts, screws, and the like. The slots 148 in the hinge plate support plate 118 and the slots 150 in the pipe support plate 120 advantageously permit those plates to be aligned and translated so as to permit the blade 130 to be raised-lowered to optimize the cleaning action of the blade on the surface of the friction roller 104.

With further reference to FIGS. 2 and 3, the pipe support 122 includes, as previously noted, the aperture 124. Positioned within the aperture 124 is the pipe 126 which connects the separate pipe supports 122. The pipe support 122 is provided (see FIG. 2) with a plurality of screw holes 142 for receipt of set screws. Thus, the blade support attachment 132 may be rotated about the longitudinal axis of the aperture 124 and may be translated along the longitudinal axis of the aperture 124 in order to optimize the positioning of the blade 130 in relation to the friction roller 104 and the edge of the stock 102. When the blade 130 is positioned as desired, the set screws (not shown) may be tightened against the pipe 126, thereby holding the blade 130 in position.

In order to provide yet a further method of positioning the blade 130, the blade support attachment 132 is provided with slots 134 and 136. These slots may be aligned with holes 158 of the blade support 128, thereby providing horizontal positioning of the blade support 128 along the axis of the slots 134, 136 and, hence, the blade 130.

As previously noted, the releaseable clip is attached to the base plate 110 and overlays a portion of the hinge plate 114. This clip advantageously restrains the movement of the cleaning unit 100 about the hinge 115 during the operation of the rolling mill section 10. However, occasionally during the operation of such section 10, problems may be encountered which cause the sheet stock 102 to become displaced from the surface of the motor driven roller 106. For example, such situation may exist if one of the motor driven rollers 106 ceases to function. In such circumstance, it is advantageous to provide a means for allowing the cleaning unit 100 to be forced out of the way so that it is not damaged in the event the sheet stock 102 "bunches" or "wracks" in the area generally described as "X" on FIG. 2. The releaseable clip 152 provides this means. Thus, if the sheet stock 102 becomes displaced from the surface of the motor driven roller 106 in the area noted as "X" in FIG. 2, and that stock moves upwardly to contact the undersurface of the cleaning unit 100, the releaseable clip will release, thereby allowing the cleaning unit 100 to rotate upwardly about the hinge 115. This action diminishes the prospect that the cleaning unit 100 will be damaged by the sheet stock 102. Further, in the event that it is necessary to work on the motor driven roller 106 or the friction roller 104 at any time, the releaseable clip 152 may be detached from the hinge plate 114 and the cleaning unit rotated, as by hand, upwardly about the hinge 115.

In order to further provide that the blade 130 makes sufficient contact with the friction roller 104 to clean that roller, the blade support 128 is preferrably made from a hard, rubber-like material. This material, however, should have sufficient resiliency such that in the event the sheet stock 102 becomes dislodged from the motor driven 106 to cause a deflection of the cleaning unit 100, as described above, upon repositioning of the cleaning unit 100 and the reattachment of the releaseable clip 152, the blade 130 will again contact the friction roller 104. This resiliency is advantageously provided by constructing the blade support 128 from a flexible rubber (e.g., from about 60 to about 80 Dur) and by further providing in the blade support 128 a blade support void 146. The blade support void 146 can be shaped in a kidney shape with the end adjacent the leading edge of the blade support 128 being smaller than the other end thereof. In addition, the blade support void 146 is, in the preferred embodiment of the present invention, pressurized to super-atmospheric pressure, such as, for example, about 7.5 atmospheres.

Figure 10:
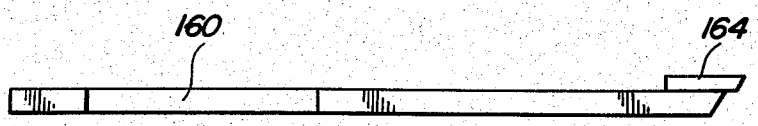
FIG. 10 is a side view of the blade used in the present invention.
Figure 9:
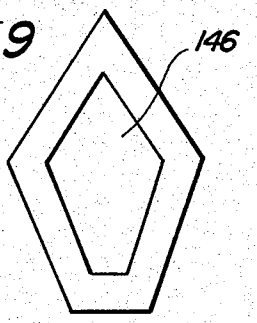
FIG. 9 is a cross section of the blade support, taken along the lines D—D of FIG. 8.

As shown in FIG. 10, the blade 130 includes a slot 160 which can be mated to the blade support 128 with bolt 144 in the blade support 128. This slot 160 permits yet a further positioning of the blade 130 in relation to the friction roller 104 by allowing the blade support 128 to be translated over the length of the slot 160. The blade 130 also includes at the leading edge thereof the sharpened tip 164, such as, for example, a tungsten carbide tip, which is attached, as by soldering with silver solder, to the blade 130. The tip 164, when the unit 100 is properly positioned, makes contact with the friction roller 104 and clean metallic and other material chips from the surface of that roller.

The alignment of the blade 130, and hence the tip 164, in relation to the friction roller 104, is important for proper operation of the cleaning unit 100. As previously noted, such alignment may be made through vertical translation of the blade 130 by positioning the slots 148 of the hinge plate support plate 118 and the slots 150 of the pipe support plate 120; the rotation of the blade support attachment 132 about the longitudinal axis of the aperture 124 and its associated pipe 126; the translation of the pipe 126 along the longitudinal axis of the aperture 124; the horizontal translation of the blade support 128 across the slots 134, 136 of the blade support attachment 132; the rotation of the blade support 128 about the bolts placed through the holes 138, 140; and the translation of the blade 130 across the slot 160. It has been determined that the tip 164 and the blade support 130 can be advantageously positioned in relation to the friction roller 104 by assuring that the contact point of the tip 164 on the friction roller 104 is located behind the vertical axis of the friction roller 104, i.e., with reference to FIG. 2, the tip 164 should be located to the left of the vertical axis (shown as a dashed line in FIG. 2) of the friction roller 104. In the preferred embodiment of the present invention, the tip 164, if it were extended through the friction roller 104 makes an angle of about 20° to about 40°, with about 30° being preferred, with the vertical axis of the friction roller 104. Such positioning assures that the tip 164 does not cut into the surface of the friction roller 104.

I claim:

1. An apparatus for cleaning rollers used in rolling mill operations comprising a blade support with a blade having a knife edge thereon attached to one end thereof, with the other end of said blade support being pivotally attached to one end of a blade support attachment means, the other end of said blade support attachment means being attached to a pivotable shaft, said pivotable shaft adapted to mate at each end thereof with apertures in a shaft support means, which shaft support means include positioning and tightening means for allowing the rotation of said pivotable shaft about the longitudinal axis thereof and the securing of said shaft, a first plate attached to said shaft support means at the end opposite said blade support, a second plate attached to a plate support means, with said first and second plates being adapted for translatable attachment to each other, a hinge with a first leaf thereof attached to said plate support means at a location opposite said second plate and the second leaf thereof being adapted for attachment to a stationary base.

2. The apparatus of claim 1, wherein said blade support comprises a flexible, curvilinear member with a void contained therein, with said void being pressurized to super atmospheric pressure.

3. The apparatus of claim 4, wherein said positioning and tightening means comprises set screws.

4. The apparatus of claim 1, further including a clip means, releaseably attachable at one end thereof to said first leaf and the other end thereof attached to said second leaf.

5. The apparatus of claim 1, wherein said blade support is pivotably attached to said blade support attachment means by a plurality of bolts passing through first spaced apart slots in said blade support attachment means and through spaced apart voids located in the end of said blade support opposite said knife edge.

6. The apparatus of claim 5, wherein said blade support is translatable in a direction parallel to the longitudinal axis of said first spaced apart slots.

7. The apparatus of claim 5, wherein said blade support is rotatable about said bolts.

8. The apparatus of claim 5 or 7, wherein said knife edge contains a slot parallel to the longitudinal axis thereof for translatable attachment to said blade support.

9. The apparatus of claim 5 or 7, wherein said first spaced apart slots are aligned parallel to the longitudinal axes of said blade support attachment means.

10. The apparatus of claim 1 wherein said first and second plates include a plurality of second spaced apart slots, with the longitudinal axes of said second slots parallel to the longitudinal axes of said first and second plates, such that when said first plate is attached to said second plate at least a portion of the slots in said first plate overlay a portion of the slots of said second plate.

11. The apparatus of claim 10, wherein said blade support attachment means is translatable along the longitudinal axes of said second spaced apart slots.

12. An apparatus for cleaning rollers used in rolling mill operations comprising a blade, with a knife edge associated therewith, having a slot parallel to the longitudinal axis thereof, a blade support, comprising a flexible, curvilinear member with a void contained therein, said void being pressurized to super atmospheric pressure, attached at one end thereof to said knife edge by a bolt passing through said slot, with the other end of said blade support being adapted for pivotable attachment to one end of a blade support attachment means, the other end of said blade support attachment means being attached to a pivotable shaft which is adapted to mate at each end thereof with apertures in a shaft support means, which shaft support means includes positioning and tightening means for allowing the rotation of said pivotable shaft and the securing of said shaft, a first plate having a plurality of first spaced apart slots, said first plate being attached to said shaft support means at the end opposite said blade support, a second plate having a plurality of second spaced apart slots, said second plate adapted for translatable attachment to said first plate such that when said second plate is attached to said first plate at least a portion of said second spaced apart slots overlay a portion of said first spaced apart slots, a plate support means attached to said second plate, a hinge with a first leaf thereof attached to said plate support means at a location opposite said second plate and the second leaf thereof being adapted for attachment to a stationary base, a clip means, releaseably attachable at one end thereof to said first leaf and the other end thereof attached to said second leaf.

* * * * *

UNITED STATES PATENT AND TRADEMARK OFFICE

CERTIFICATE OF CORRECTION

PATENT NO. : 4,528,716

DATED : July 16, 1985

INVENTOR(S) : George C. Perneczky

It is certified that error appears in the above—identified patent and that said Letters Patent is hereby corrected as shown below:

Column 1, line 52, "downtime" should be --down-time--.

Column 3, line 33, "driver" should be --driven--.

Column 6, line 46, delete "about the bolts" and insert --placed through the holes--.

Column 7, line 19, "4," should be --1,--.

Column 7, line 42, "axes" should be --axis--.

Column 8, line 1, "1" should be --1,--.

Column 8, line 3, "axes" should be --axis--.

Column 8, line 4, "axes" should be --axis--.

Column 8, line 10, "axes" should be --axis--.

Column 8, line 20, "a" should be --said--.

Signed and Sealed this

*First* Day of *April 1986*

[SEAL]

*Attest:*

*Attesting Officer*

DONALD J. QUIGG

*Commissioner of Patents and Trademarks*